United States Patent [19]

Wagner

[11] Patent Number: 4,836,740

[45] Date of Patent: Jun. 6, 1989

[54] PIVOTAL ATTACHMENT STRUCTURE

[75] Inventor: Oryn B. Wagner, Bismarck, N. Dak.

[73] Assignee: Clark Equipment Company, South Bend, Ind.

[21] Appl. No.: 137,906

[22] Filed: Dec. 28, 1987

[51] Int. Cl.[4] ..... E02F 3/00

[52] U.S. Cl. ..... 414/686; 280/421; 414/918

[58] Field of Search ..... 414/686, 694, 695.5, 414/DIG. 918; 280/421

[56] References Cited

U.S. PATENT DOCUMENTS 4,142,642 3/1970 Myers ..... 280/421 X 4,208,162 6/1980 Neitzel ..... 414/686

4,661,036 4/1987 Horsch ..... 414/686

*Primary Examiner*—Robert J. Spar

*Assistant Examiner*—Donald W. Underwood

*Attorney, Agent, or Firm*—Kenneth C. Witt

[57] ABSTRACT

An attaching structure for securing a detachable hydraulically operated attachment to a vehicle. There is a source of hydraulic pressure on the vehicle. Hydraulic fluid from the source is circulated through valves and conduits to and from hydraulic devices which are carried by and operate the attachment. The valve which controls the hydraulic fluid to the attachment is mounted on the attachment, and remains with the attachment when the attachment is detached from the vehicle.

6 Claims, 4 Drawing Sheets

34
31
18
28
22
38
20
36
32
40
49
24
10

18
18
26
40
24
46
44
22
22
20

12
16
14
65
11
75
22
28a
73
18
20
71

75
79
72
84
31
22
71

Fig. 7
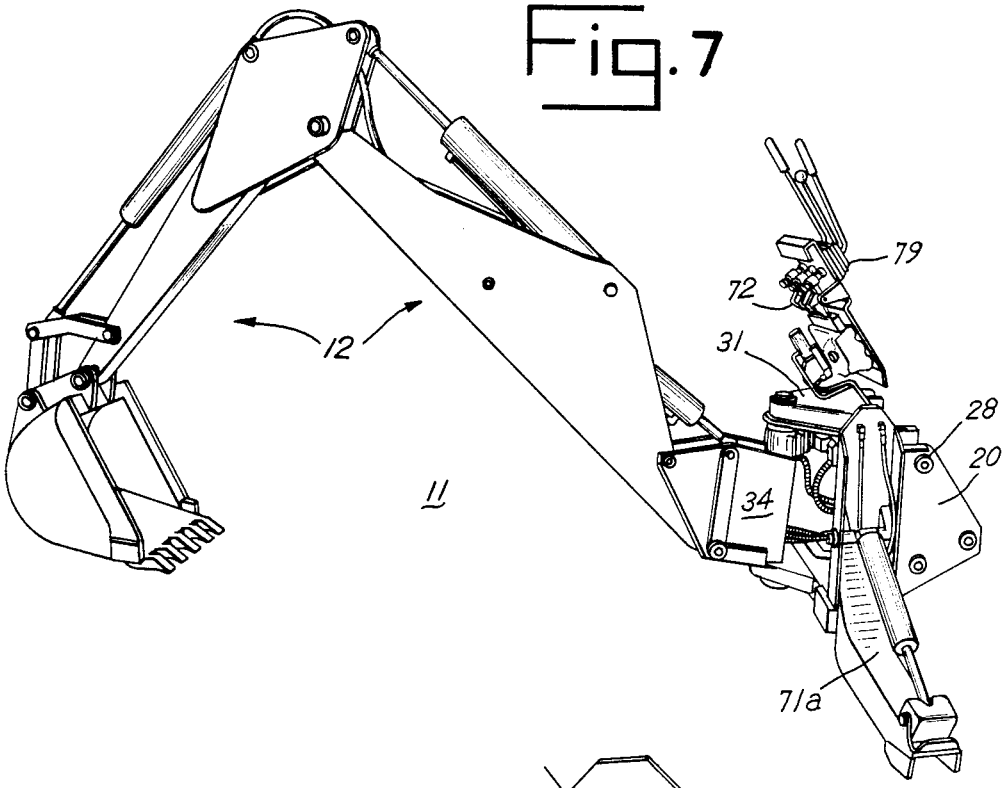
Fig. 8
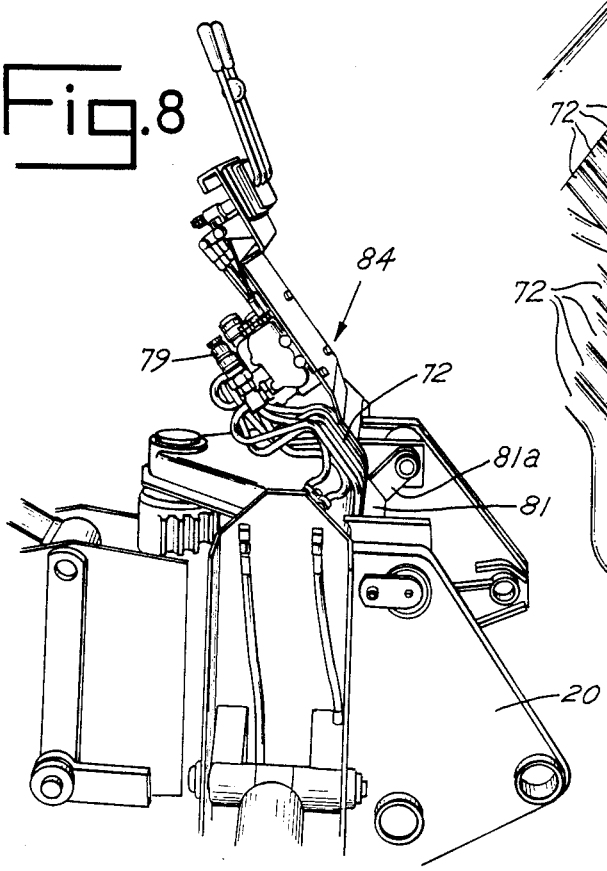
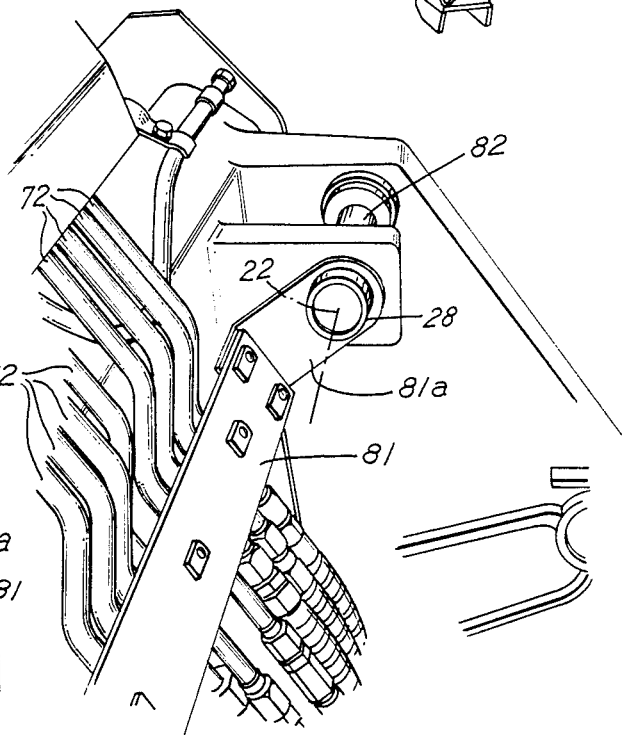
Fig. 9

PIVOTAL ATTACHMENT STRUCTURE

CROSS REFERENCE:

This application is related to U.S. application Ser. No. 07/028,414 dated Mar. 20, 1987, U.S. Pat. No. 4,735,547, issued Apr. 5, 1988, in that the structures of both can be used on the same vehicle.

BACKGROUND OF THE INVENTION

1. Field of the Invention

This invention relates to work vehicles and more particularly to vehicles on which an attachment or implement is mounted to enable the vehicle to function as a working machine.

2. Description of the Prior Art

In the above-mentioned application there is a mechanism for mounting a backhoe on a vehicle including a backhoe mounting subframe having a downwardly extending work position and a transport position in which it is pivoted upwardly and outwardly from the work position. The backhoe mounting subframe is pivotally mounted about an axis transverse to the frame of the vehicle. The backhoe mounting subframe is movable at the operator's option between the work position and the transport position, and means are provided for positively latching the backhoe mounting subframe to the vehicle frame either at the work position or at the transport position. In U.S. Pat. No. 4,142,642 Myers dated Mar. 6, 1979 hydraulic fluid conduits are disposed in a counterweight which is adapted to be secured between a tractor and an earth-working implement such as a backhoe. The counterweight has a tractor-engaging side and an earth-working implement-engaging side from which the conduits extend. The conduits are equipped with hydraulic couplings for mating with the hydraulic lines from the tractor and an earth-working implement.

SUMMARY OF THE INVENTION

In the present invention a structure for securing a detachable attachment to a vehicle includes a vehicle frame extending near one end of the vehicle. The structure includes a subframe which is attachable to the frame and also includes at least one hydraulic device for operating the attachment. There is a source of pressurized hydraulic fluid on the vehicle and hydraulic connections between the source and the hydraulic device. The hydraulic connections include a valve for positioning the attachment for disconnecting the attachment from the source, and the valve is located on the attachment, whereby when the subframe is detached from the vehicle frame the hydraulic valve remains with the attachment; the hydraulic source remains with the vehicle. Reversely the hydraulic lines are connected and the hydraulic valves can be functioned to position the subframe for attachment to the vehicle frame by positioning the stabilizers, boom and dipper for alignment and hookup.

BRIEF DESCRIPTION OF THE DRAWING

FIG. 7 is a partial view of the same side as FIG. 1, FIG. 8 is a perspective view of a portion of the invention from the same side as FIG. 1, and FIG. 9 is another perspective view of a portion of the invention, also from the same side as FIG. 1.

DESCRIPTION OF THE PREFERRED EMBODIMENT

Figure 1:
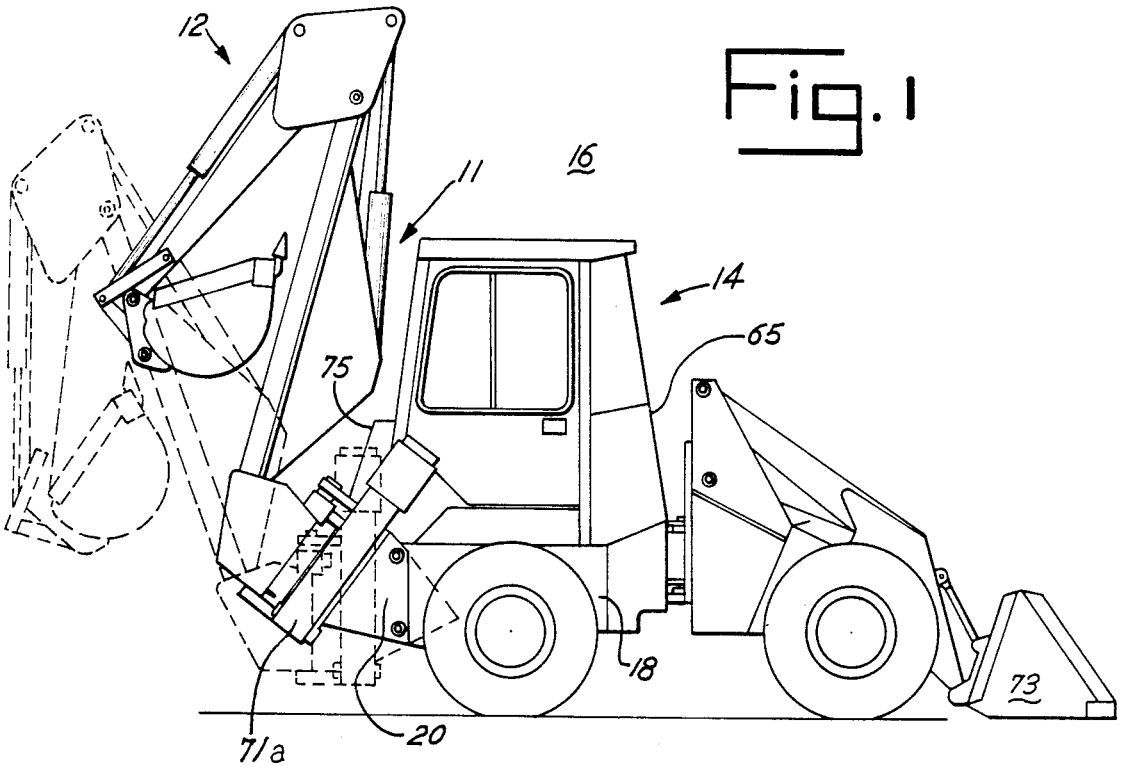
FIG. 1 is a profile view of a vehicle with attachment which embodies this invention.
Figure 2:
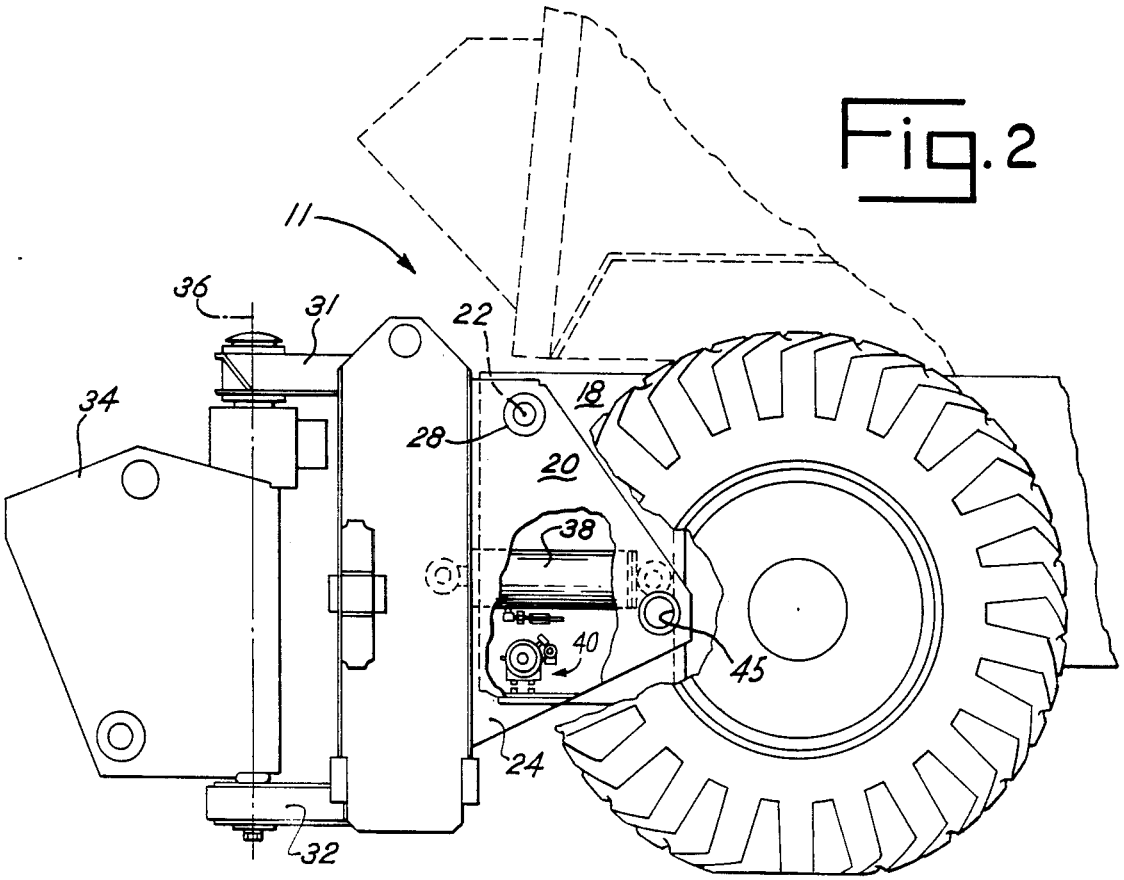
FIG. 2 is a partial side elevation of the vehicle and attachment with the attachment in the work position.
Figure 3:
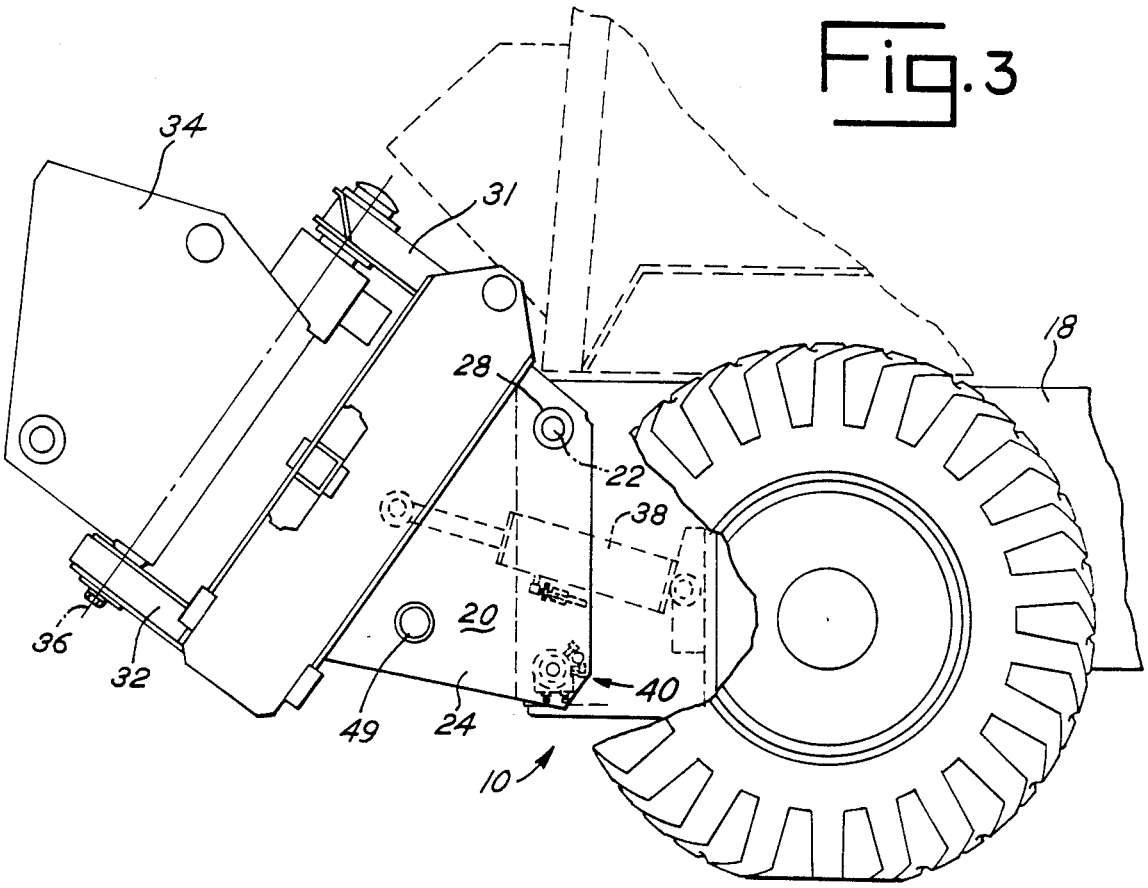
FIG. 3 is a similar partial side elevational view with the attachment in the transport position.
Figure 4:
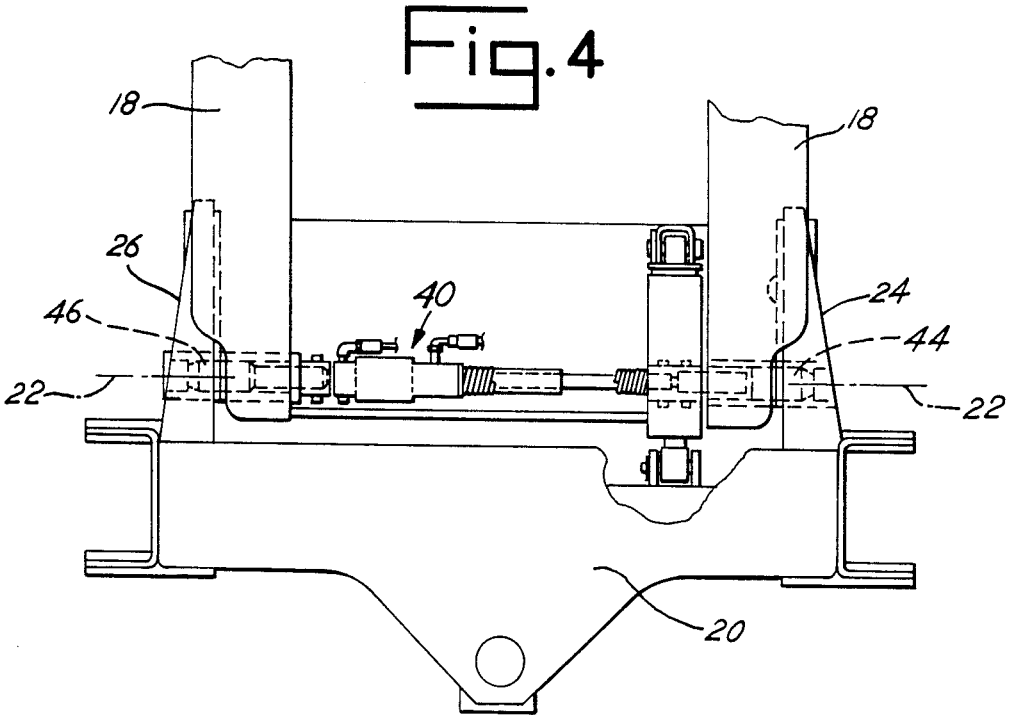
FIG. 4 is a partial plan view of a vehicle embodying the present invention shown in the work position.
Figure 5:
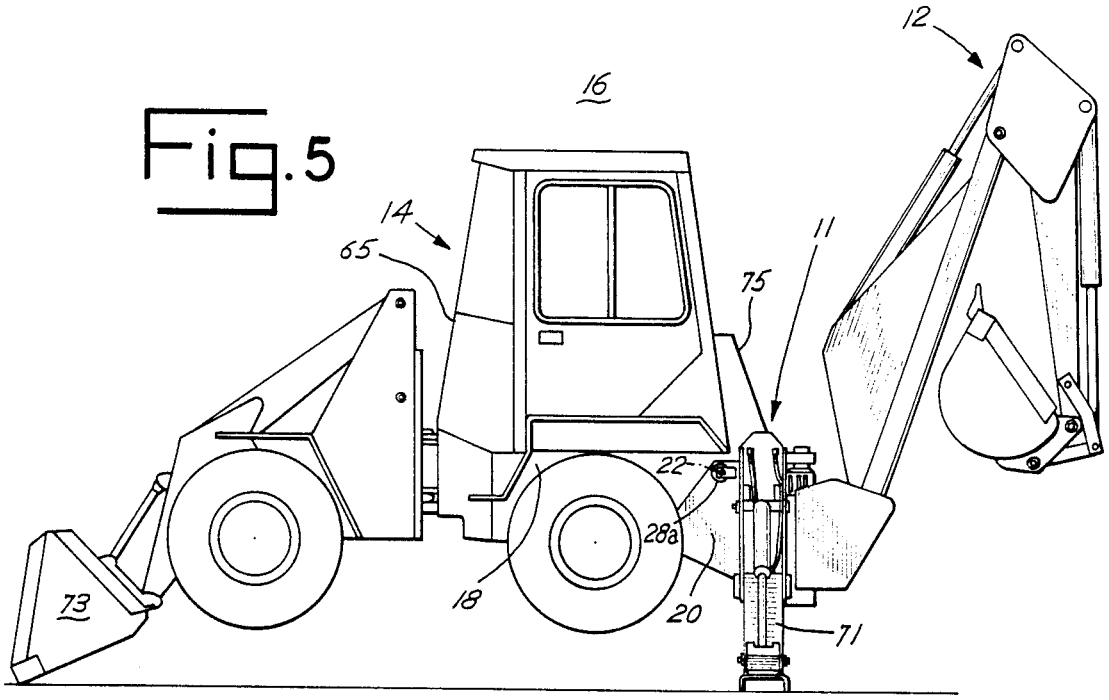
FIG. 5 is a view of the other side of the vehicle from FIGS. 1–3, showing the attachment in the work position.

In FIG. 1 and in other Figures the numeral 11 indicates generally a vehicle attachment structure according to the present invention. As shown a backhoe 12 is mounted by means of the present invention on a vehicle 14 to form an excavator machine which is designed in its entirety by the numeral 16. The vehicle 14 includes a main frame member 18 which is seen in FIGS. 1–3 and 5. An attachment (backhoe) mounting subframe 20 is pivotally mounted on frame 18 to pivot about axis 22 adjacent the upper margin of the frame. As seen in FIG. 2 and FIG. 4 the attachment mounting subframe 20 includes a pair of longitudinally extending vertical brackets 24 and 26 pivotally connected to the two sides of the vehicle frame 18 to pivot the subframe 20 on frame 18 about axis 22. The axis 22 is formed by a pair of pivot pins on opposite sides of the vehicle and subframe, the pin on the near side in FIGS. 2 and 3 being indicated by the numeral 28, while the pin on the other side as shown in FIG. 5 is indicated by character **28*a*. The subframe 20 is pivoted about axis 22 by means of a hydraulic device 38, shown in the cutaway portion of FIG. 2, to move it between two extremes. At one extreme the hydraulic device 38 is extended, as seen in FIG. 3, to permit hydraulic device 40 to extend pins 44 and 46 to mate with opening 45 (shown in FIG. 2) and a corresponding opening on the far side of the vehicle. When the hydraulic device is contracted, as in FIG. 2, hydraulic device 40 may be actuated to cause the pins to extend to mate with opening 49, shown in FIG. 3, and a corresponding opening on the other side of the subframe. Subframe 20 also includes a pair of outwardly extending upper and lower horizontally disposed bracket portions 31 and 32; see FIGS. 2 and 3. Also included in the pivotal attachment structure 11 is a swing frame 34 which is connected between horizontal brackets 31 and 32 to pivot about axis 36 with respect to such brackets. This swing frame construction allows the backhoe 12 which is mounted on swing frame 34** to pivot through an arc of almost 180° from one side of the machine to the other.

In FIG. 5 of the drawing there is shown a side elevational view of the vehicle 14 from the side opposite to FIG. 1. In this view there is a stabilizer 71 on the near side of the machine, and it is duplicated in mirror image on the other side and indicated by the character 71a; see FIGS. 1 and 7. These stabilizers are secured to the subframe 20 and as illustrated in FIGS. 5 and 7 they may be utilized to raise the adjacent wheels off the ground during operation of the backhoe attachment. At the same time during digging operation the wheels at the other end of the vehicle can be raised off the ground by lowering a loader bucket 73 as indicated in FIG. 5. Stabilizer **71*a* in the retracted condition appears in FIG. 1** of the drawing.

Figure 6:
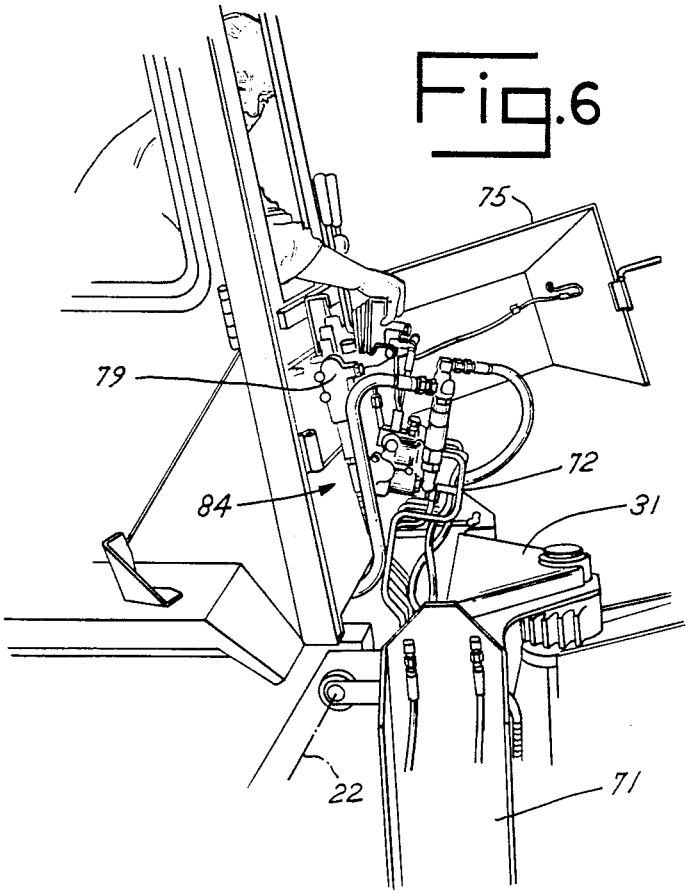
FIG. 6 is a partial view from the same side as FIG. 5.

Also shown in FIGS. 1 and 5 is a cab 65 for the protection and comfort of the operator and a pivoted cover 75 (shown closed in FIGS. 1 and 5) projecting from the cab which covers a bank 79 of valves and the related flexible hydraulic conduits 72 by which the backhoe 12 and stabilizers 71 and 71a are operated. The valve bank 79 and conduits 72 are collectively referred to an hydraulic connections 84. FIG. 6 of the drawing shows the cover 75 open and the valve bank 79 and conduits 72 visible. Also, they are shown pivoted a small amount outwardly, and this is explained later. FIG. 6 also shows the vehicle in the non-working position with the wheels on the ground and the stabilizers retracted. The cover 75 can be pivoted outwardly about a vertically disposed axis as shown in FIG. 6 to allow the hydraulic connections 84 of backhoe attachment 12 to be detached from or attached to the body portion of the vehicle which carries the source of hydraulic pressure.

FIG. 7 of the drawing shows a view from the same side of the vehicle as FIG. 1, and shows the attachment 11 including subframe 20 removed from the remainder of the vehicle. It will be observed that valve bank 79 and conduits 72 have remained with the attachment. FIG. 8 of the drawing is a larger partial view showing the valve bank 79 from the side as FIG. 7, and FIG. 9 is a still larger view of the hydraulic conduits from a slightly different perspective. As shown in FIG. 9 the conduits 72 are mounted on a bracket 81 which includes a right angle portion **81*a* at the end which encircles a shaft 82 which is coaxial with pivot axis 22 about which the subframe 20 pivots. During the attaching of the attachment 11 to the vehicle 14 and the detaching of the attachment from the vehicle, the valve bank 79 and conduits 72 are manually pivoted with bracket 81 about axis 22. During operation the valve bank is secured to vehicle 14** and to the source of pressurized hydraulic fluid. Valve bank as used herein means one or more valves, and there are an equal number of flexible conduits (hoses) connected to the valves respectively.

To facilitate an understanding of the present invention the following description is provided, beginning with the attachment 11 in the detached condition of FIG. 7. To commence the attaching maneuver the vehicle which is to carry the attachment is aligned with the attachment adjacent thereto in the manner shown in FIG. 6, and pins 28 and **28*a* are inserted to provide pivot axis 22. See FIGS. 7 and 5 respectively for these pins. The valve bank 79 and conduits 72 ae then manually pivoted counterclockwise in FIG. 6 about axis 22 to the mounted position where they can be secured to the vehicle body and the hydraulic pump, not shown, to provide hydraulic pressure for the attachment. Next, brackets 24 and 26 of the attachment are pivotally connected to frame 18 of the vehicle in the mounted position by pins 28 and 28*a*, and device 38 which has one end pivotally connected to the attachment 11 is pivotally connected at its other end to vehicle 14. Then, after closing cover 75 and moving the machine to the job site and lowering the stabilizers 71, the machine is ready for backhoe operation. FIG. 5** illustrates the ready-for-operation condition. To detach the attachment from the vehicle the reverse of these steps is followed.

Reference herein to a hydraulic device means a double acting linear hydraulic cylinder having a cylindrical barrel portion closed at both ends, with a piston mounted on a piston rod and reciprocal in the barrel portion, forming two variable volume chambers, with the piston rod projecting through one of the closed ends, and equivalent devices.

While I have described and illustrated herein a preferred embodiment of my invention which is also the best mode contemplated for carrying it out, it will be understood that changes and modifications may be made. It should be understood, therefore, that I intend to cover by the appended claims all such changes and modifications which fall within the true spirit and scope of my invention.

I claim:

1. A structure for detachably securing an attachment to a vehicle which has a frame and includes a source of pressurized hydraulic fluid, comprising a subframe forming a part of said attachment and pivotally attachable to said frame by spaced apart pins forming a transverse pivot axis;

said attachment including at least one hydraulically operated means for pivoting said subframe relative to said frame about said transverse axis, hydraulic connections connectible between said source and said means, said hydraulic connections including a valve for hydraulically connecting said attachment to and disconnecting said attachment from said source and a flexible hydraulic conduit, a bracket pivotable on said pins about said axis, and said valve and said hydraulic conduit secured to said bracket, whereby when said subframe is detached from said frame said means and said valve remain with said attachment.

2. A structure as in claim 1 wherein a portion of said vehicle frame extends near one end of said vehicle, and said subframe is pivotally connectible to said portion.

3. A structure as in claim 1 wherein said hydraulic connections include a plurality of valves and a plurality of hydraulic conduits.

4. A structure as in claim 1 wherein said transverse axis is formed by a pair of removable pivot pins extending transversely through opposite sides of said frame and said attachment.

5. A structure as in claim 1 wherein when said subframe is attached to said frame said bracket and said valve are in their mounted position.

6. A structure as in claim 5 wherein said valve can be operated by an operator in said vehicle when said bracket and said valve are in their mounted position.

* * * * *